US006885137B2

(12) United States Patent
Kanao et al.

(10) Patent No.: US 6,885,137 B2
(45) Date of Patent: Apr. 26, 2005

(54) SPARK PLUG AND ITS MANUFACTURING METHOD

(75) Inventors: Keiji Kanao, Aichi-ken (JP); Tsunetoshi Goto, Handa (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/694,830

(22) Filed: Oct. 29, 2003

(65) Prior Publication Data

US 2004/0100178 A1 May 27, 2004

(30) Foreign Application Priority Data

Nov. 22, 2002 (JP) ..... 2002-339245

(51) Int. Cl.[7] ..... H01T 13/20; H01T 13/00; H01T 13/46; H01T 13/28; H01T 13/22

(52) U.S. Cl. ..... 313/141; 313/118; 313/124; 313/133; 313/136; 313/138; 313/142; 313/144; 445/7

(58) Field of Search ..... 313/118, 124, 313/133, 136, 138, 141, 142, 144; 445/7

(56) References Cited

U.S. PATENT DOCUMENTS 5,856,724 A * 1/1999 Chiu et al. ..... 313/141
5,877,584 A * 3/1999 Kato et al. ..... 313/143
5,977,695 A 11/1999 Osamura et al.

FOREIGN PATENT DOCUMENTS

JP 3000955 11/1999

* cited by examiner

*Primary Examiner*—Nimeshkumar D. Patel
*Assistant Examiner*—Matt Hodges
(74) *Attorney, Agent, or Firm*—Nixon & Vanderhye P.C.

(57) ABSTRACT

Ir alloy firing tips are bonded on opposed surfaces of a center electrode and a ground electrode facing to a discharge gap. The configuration of a cross-sectional area of the Ir alloy firing tip taken along a plane perpendicular to the axis of the Ir alloy firing tip is out of round. In this cross-sectional area of this Ir alloy firing tip, when it is assumed that a circumscribed circle has a largest diameter A among virtual circles each contacting at least three portions of a visible outline of the cross-sectional area and an inscribed circle has a largest diameter B among inscribed circles each being coaxial with the circumscribed circle, a ratio of the diameter B to the diameter A (i.e., B/A) is equal to or larger than 0.8 and is less than 1.0.

6 Claims, 12 Drawing Sheets

$$\frac{Y1+Y2}{X}$$

SPARK PLUG AND ITS MANUFACTURING METHOD

BACKGROUND OF THE INVENTION

The present invention relates to a spark plug for an internal combustion engine which including an Ir (iridium) alloy firing tip connected to an opposed portion of at least one of a center electrode and a ground electrode opposed via a discharge gap intervening therebetween. Furthermore, the present invention relates to a method for manufacturing this spark plug. The present invention is applicable to various kinds of spark plugs used in automotive vehicles, cogeneration facilities, gas pressure pumps, etc.

In general, a spark plug has a center electrode, an insulator holding the center electrode, a housing holding and fixing the insulator, and a ground electrode having one end portion connected to the housing and the other end portion opposed to the center electrode via a discharge gap.

According to this king of spark plug, to assure long-lasting lifetime for satisfying the requirements of high performance and easy maintenance of the engines, an Ir alloy firing tip is disposed on a spark discharge portion of the center electrode or the ground electrode which is an opposed portion of the center electrode or the ground electrode facing to a discharge gap.

The Ir alloy is greatly different from the electrode base material (e.g., nickel alloy etc.) in thermal expansion coefficient. Hence, it is necessary to prevent the Ir alloy firing tip from falling off the electrode due to generation of a thermal stress. To this end, a laser welding is applied to form a fused layer between the Ir alloy firing tip and the electrode base material so that the fused layer has an intermediate thermal expansion coefficient compared with those of the Ir alloy and the electrode base material, thereby reducing the thermal stress acting between the Ir alloy firing tip and the electrode and assuring excellent bondability between them.

According to the laser welding method, the Ir alloy firing tip is integrated beforehand with the electrode base material by resistance welding or the like, and then a laser is irradiated onto an entire circumferential surface of the Ir alloy firing tip while the integrated assembly is rotated about the axis of the Ir alloy firing tip In this case, the laser weldability is greatly influenced by the configuration of the firing tip and the electrode base material at each laser irradiation position. If the configuration of the firing tip and the electrode base material relative to the laser beam is not uniform at each laser irradiation position, the melting process of the welded portion will be different at each laser irradiation position. The bondability between the Ir alloy firing tip and the electrode cannot be assured. Accordingly, it is usual that the conventional Ir alloy firing tip is configured into a columnar or cylindrical shape so that the configuration of the firing tip is constant at each laser irradiation position when the firing tip is rotated about its axis during the welding operation.

However, configuring the Ir alloy firing tip into a columnar or cylindrical shape requires essentially a rolling process, a wiredrawing process, and many other processes (for example, refer to Japanese Patent No. 3000955 corresponding to U.S. Pat. No. 5,977,695).

Furthermore, to reduce the manufacturing costs, it is conventionally proposed to use an Ir alloy firing tip having a quadrangular or hexagonal configuration in the cross section taken along a plane perpendicular to the axis of the firing tip and being bonded to the electrode by laser welding (for example, refer to Japanese Patent No. 3000955 corresponding to U.S. Pat. No. 5,977,695).

However, according to the evaluations conducted by the inventors of this invention, the firing tip having a quadrangular or hexagonal configuration in the cross section has so small apical or face angle that a large stress is concentrated to the welding portion of the firing tip and the electrode due to the edge effect. Thus, the quadrangular or hexagonal firing tip cannot assure satisfactory bondability, compared with a columnar firing tip.

SUMMARY OF THE INVENTION

In view of the foregoing problems, the present invention has an object to provide a spark plug capable of not only simplifying the machining or manufacturing processes of the Ir alloy firing tip but also securing the bondability of the firing tip which is bonded to an electrode base material by the laser welding operation.

The inventors of this invention put emphasis on the disadvantage of complicated machining processes necessary in configuring the Ir alloy firing tip into a columnar shape, although they recognize excellent bondability of the circular firing tip in the laser welding operation brought by the circular firing tip. The inventors of this invention, thus, studied the possibility of improving the bondability of a non-columnar firing tip to a level comparable with a columnar firing tip.

More specifically, when the rod-like Ir alloy firing tip is usable even if its cross-sectional area taken along a plane perpendicular to its axis is out-of-round configuration, the machining processes for the firing tip can be greatly simplified. Hence, the inventors studied the allowable range of the out-of-roundness of the cross-sectional area of the firing tip with respect to the bondability.

To this end, the inventors of this invention assume the presence of a circumscribed circle having a largest diameter A among virtual circles contacting at least three portions of a visible outline of the cross-sectional area as well as the presence of an inscribed circle having a largest diameter B among inscribed circles being coaxial with the above circumscribed circle (refer to FIGS. 3A and 3B).

Furthermore, the inventors of this invention employ a ratio B/A, i.e., a ratio of the diameter B of the above-described inscribed circle to the diameter A of the above-described circumscribed circle, as a parameter indicating the degree of out-of-roundness of the Ir alloy firing tip in evaluating the bondability of the firing tip in the laser welding operation. When the ratio B/A is close to 1, the cross-sectional configuration is close to the complete roundness. When the ratio B/A is far from 1, the cross-sectional configuration is far from the complete roundness.

As a result, the inventors of this invention have derived the conclusion that the non-columnar Ir alloy firing tip can assure excellent bondability equivalent to that of a columnar Ir alloy firing tip when the ratio B/A is within a predetermined region closer to the complete roundness (refer to FIGS. 8 and 9). In this manner, this invention is based on experimental data and evaluations obtained by the inventors.

In order to accomplish the above and other related objects, the present invention provides a spark plug including a center electrode, an insulator holding the center electrode, a housing holding and fixing the insulator, and a ground electrode having one end portion connected to the housing and the other end portion opposed to the center electrode via a discharge gap intervening therebetween. An Ir alloy firing tip made of a rod-like Ir alloy is connected to a portion of at least one of the center electrode and the ground electrode facing to the discharge gap. According to the spark plug of this invention, a cross-sectional area of the Ir alloy firing tip taken along a plane perpendicular to an axis of the Ir alloy firing tip has an out-of-round configuration. In the cross-sectional area of the Ir alloy firing tip, when a circumscribed circle has a largest diameter A among virtual circles contacting at least three portions of a visible outline of the cross-sectional area and an inscribed circle has a largest diameter B among inscribed circles being coaxial with the circumscribed circle, a ratio of the diameter B to the diameter A (i.e., B/A) is equal to or larger than 0.8 and is less than 1.0. The visible outline of the cross-sectional area is constituted by a serial joint of at least seven straight or curved line elements, and an angle between each line element and an adjacent line element is not less than 125° and is not larger than 235°.

According to the spark plug of this invention, the shape of the Ir alloy firing tip is out of round in the cross-sectional configuration taken along a plane perpendicular to the axis of the Ir alloy firing tip. Thus, the present invention makes it possible to selectively use many types of Ir alloy firing tips which are polygonal or non-columnar in the cross-sectional configuration. The machining costs can be reduced greatly compared with the case that the firing tip is configured into a columnar shape. Thus, the machining processes for the Ir alloy firing tip can be simplified.

The inventors of this invention have experimentally confirmed that, even if the Ir alloy firing tip is out of round in cross-sectional configuration, the obtained bondability of this firing tip is equivalent to that of a columnar Ir alloy firing tip when the ratio B/A is equal to or larger than 0.8 and is less than 1.0.

Furthermore, according to the spark plug of this invention, the visible outline of the cross-sectional area is constituted by a serial joint of at least seven straight or curved line elements, and an angle between each line element and an adjacent line element is not less than 125° and is not larger than 235°.

Accordingly, the present invention can provide a spark plug capable of simplifying the machining processes for the Ir alloy firing tip and also securing the bondability of the Ir alloy firing tip in the laser welding operation.

Preferably, the ratio B/A is not larger than 0.96.

Preferably, the diameter A of the circumscribed circle is not less than 0.3 mm and is not larger than 1.5 mm from the following reasons.

If the diameter A of the circumscribed circle is less than 0.3 mm, the thermal capacity of the Ir alloy firing tip will be too small even if this firing tip has excellent exhaustion resistance. Due to tip temperature increase, exhaustion of the firing tip will be so promoted that satisfactory lifetime cannot be assured. On the other hand, if the diameter A of the circumscribed circle is larger than 1.5 mm, the tip size becomes too large to reduce the thermal stress for assuring sufficient bondability even if a fused layer serving as a relaxing layer is formed by laser welding.

Preferably, the Ir alloy firing tip includes Ir of 50% or more by weight and at least one additive, and has a melting point not lower than 2,000° C.

To secure satisfactory spark exhaustion resistance, having a melting point not lower than 2,000° C. is important for the Ir alloy to rely on excellent properties of Ir which has inherently a high melting point. Furthermore, using a pure Ir firing tip containing no additive will encounter with the problem of oxidation and volatilization of Ir.

Preferably, at least one additive contained in the Ir alloy firing tip is selected from the group consisting of Pt, Rh, Ni, W, Pd, Ru, Os, Al, Y, and $Y_2O_3$. These additives possess the capability of forming a film on the surface of the firing tip and accordingly effectively suppress oxidation and volatilization of Ir.

Furthermore, the present invention provides a method for manufacturing a spark plug including a center electrode, an insulator holding the center electrode, a housing holding and fixing the insulator, and a ground electrode having one end portion connected to the housing and the other end portion opposed to the center electrode via a discharge gap intervening therebetween, wherein an Ir alloy firing tip made of a rod-like Ir alloy is connected to a portion of at least one of the center electrode and the ground electrode facing to the discharge gap. More specifically, a cross-sectional area of the Ir alloy firing tip taken along a plane perpendicular to an axis of the Ir alloy firing tip has an out-of-round configuration. In the cross-sectional area of the Ir alloy firing tip, when a circumscribed circle has a largest diameter A among virtual circles contacting at least three portions of a visible outline of the cross-sectional area and an inscribed circle has a largest diameter B among inscribed circles being coaxial with the circumscribed circle, a ratio of the diameter B to the diameter A (i.e., B/A) is equal to or larger than 0.8 and is less than 1.0.

The manufacturing method of the present invention includes a step of configuring the cross-sectional area of the Ir alloy firing tip in such a manner that the visible outline is constituted by a serial joint of at least seven straight or curved line elements and an angle between each line element and an adjacent line element is not less than 125° and not larger than 235°, and a step of welding an entire circumferential surface of the Ir alloy firing tip by laser welding to the portion of at least one of the center electrode and the ground electrode facing to the discharge gap.

Thus, according to the manufacturing method of the present invention, the above-described spark plug can be manufactured appropriately. Each of the above-described preferable Ir alloy firing tips can be used in the manufacturing method of this invention.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Preferred embodiments of the present invention will be explained hereinafter with reference to attached drawings.

PREFERRED EMBODIMENTS OF THE INVENTION

Figure 1:
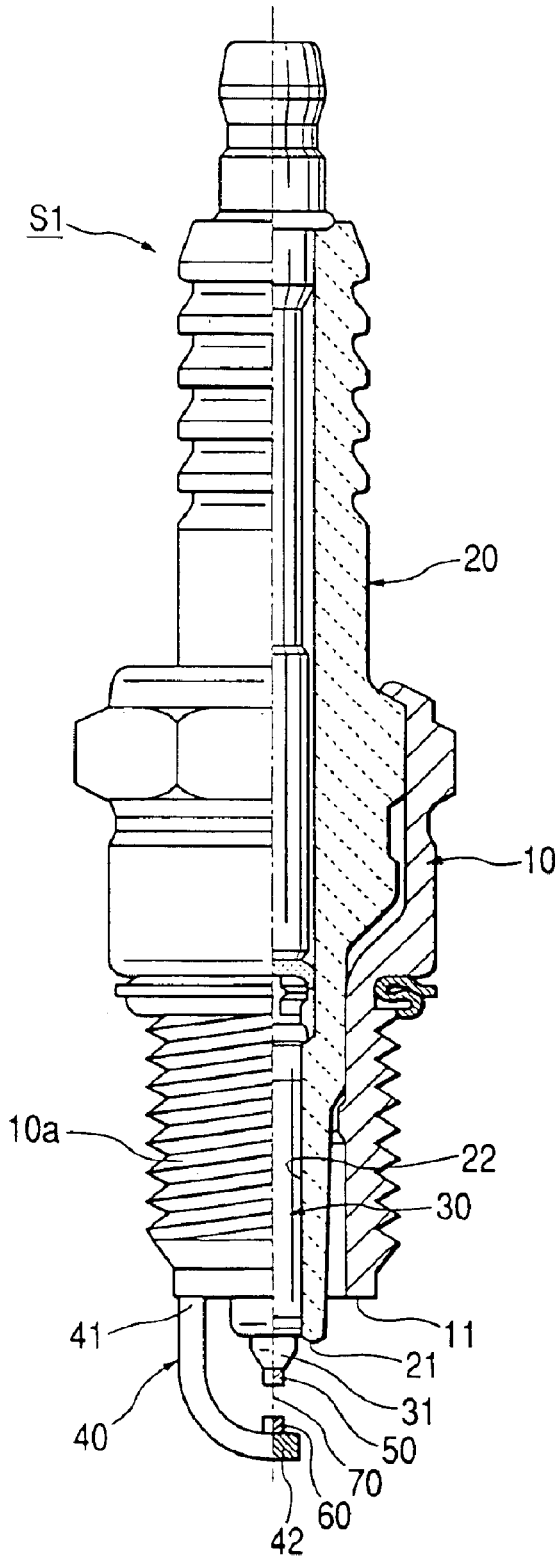
FIG. 1 is a half-sectional view showing the overall arrangement of a spark plug in accordance with a preferred embodiment of the present invention.
Figure 2:
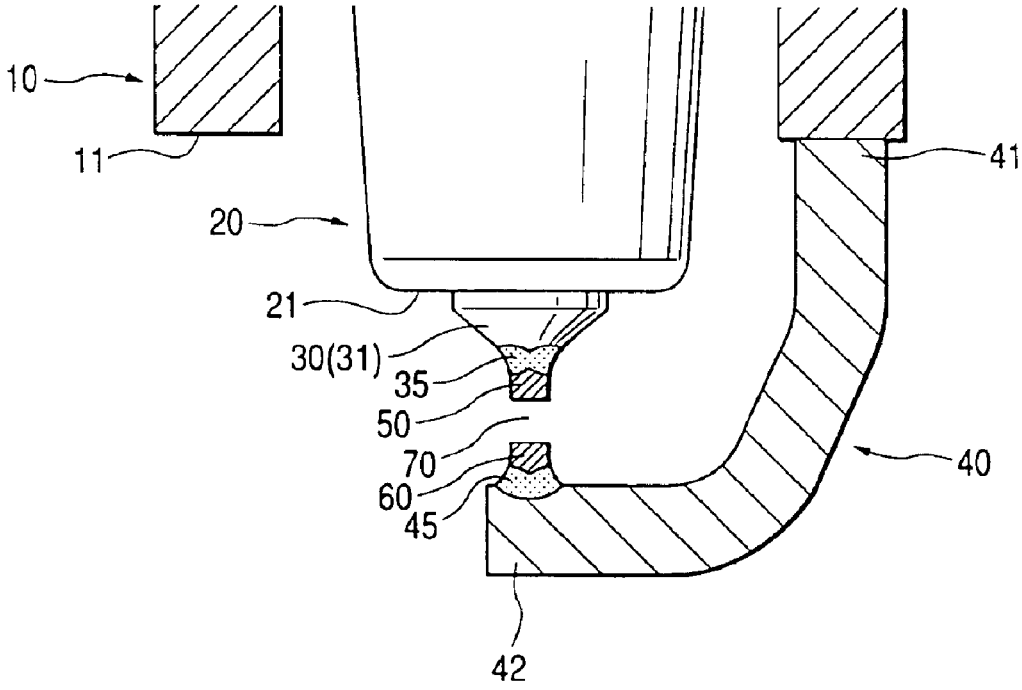
FIG. 2 is an enlarged cross-sectional view showing a spark discharge portion and its vicinity of the spark plug shown in FIG. 1.

Hereinafter, preferred embodiments of the present invention will be explained with reference to attached drawings. FIG. 1 is a half-sectional view showing the overall arrangement of a spark plug S1 in accordance with a preferred embodiment of the present invention. FIG. 2 is an enlarged cross-sectional view showing a spark discharge portion and its vicinity of the spark plug S1 shown in FIG. 1.

The spark plug S1 is used as an ignition plug for an internal combustion engine of an automotive vehicle. The spark plug S1 is inserted and fixed in a screw hole opened in an engine head (not shown) which defines a combustion chamber of the engine.

The spark plug S1 has a cylindrical metal housing 10 which is made of a low-carbon steel or a comparable electrically conductive steel member. The metal housing 10 is provided with a male threaded portion (not shown). The spark plug S1 is firmly fixed to the engine head of an internal combustion engine by engaging the threaded portion of the metal housing 10 into a screw hole of the engine head, so that a center electrode 30 and a ground electrode 40 are exposed into a combustion chamber of the engine. A cylindrical insulator 20, made of an alumina ($Al_2O_3$) etc. having excellent insulation properties, is securely disposed inside the metal housing 10. One end (i.e., distal end) portion 21 of insulator 20 protrudes out of an axial end (i.e., distal end) portion 11 of the metal housing 10.

The center electrode 30 is securely supported in an axial hole 22 of the insulator 20. In other words, the center electrode 30 is insulated from the metal housing 10 via the insulator 20. The center electrode 30 is a metallic rod member configured into a cylindrical shape including an internal layer made of Cu or a comparable metallic member having excellent thermal conductivity and an external layer made of a Ni-based alloy, a Fe-based alloy, a Co-based alloy, or a comparable metallic member possessing excellent heat resistance and corrosion resistance. As shown in FIG. 2, one end portion 31 of center electrode 30 protrudes out of the one end portion 21 of insulator 20.

The ground electrode 40 is a metallic rod member configured into a curved square rod or the like and is made of a Ni-based alloy or the like. The ground electrode 40 includes a leg portion 41 extending substantially parallel to an axis of the center electrode 30 and an opposed portion 42 extending in a direction substantially normal to the axis of the center electrode 30. One end (proximal end side) of the leg portion 41 is welded to the axial end portion 11 of the metal housing 10. The other end of the leg portion 41 bends at its intermediate region and continuously changes or merges into the opposed portion 42 positioned at the distal end side of the ground electrode 40. The opposed portion 42 is opposed to the distal end (i.e., a top) of the center electrode 30 in the axial direction of the center electrode 30.

A noble metallic firing tip 50, made of a rod-like Ir (iridium) alloy, is bonded to the one end portion 31 of the center electrode 30 so as to serve as a center electrode firing tip. Another noble metallic firing tip 60, made of a rod-like Ir (iridium) alloy, is bonded to the opposed portion 42 of the ground electrode 40 so as to serve as a ground electrode firing tip. A discharge gap 70 is formed between the center electrode firing tip 50 and the ground electrode firing tip 60.

As shown in FIG. 2, the center electrode firing tip 50 is welded to the center electrode 30 serving as one electrode base material by laser welding applied on the entire circumferential surface of the center electrode firing tip 50. Similarly, the ground electrode firing tip 60 is welded to the ground electrode 40 serving as the other electrode base material by laser welding applied on the entire circumferential surface of the ground electrode firing tip 60. The applied laser welding leaves a fused layer 35 intervening between the center electrode firing tip 50 and the electrode base material 30 and a fused layer 45 intervening between the ground electrode firing tip 60 and the electrode base material 40. In other words, the rod-like electrode firing tips 50 and 60 are bonded via the fused layers 35 and 45 to the electrode base materials 30 and 40, respectively.

According to the above-described embodiment, the Ir alloy firing tips 50 and 60 are bonded to the surfaces of the center electrode 30 and the ground electrode 40 being opposed to each other via the discharge gap 70. However, this invention is also applicable to a spark plug having only one Ir alloy firing tip provided on the center electrode 30 or the ground electrode 40.

Furthermore, each of the Ir alloy firing tips 50 and 60 contains Ir of 50% or more by weight and at least one additive. Each of the Ir alloy firing tips 50 and 60 has a melting point not lower than 2,000° C. The additive for the Ir alloy firing tips 50 and 60 is selected from the group consisting of Pt, Rh, Ni, W, Pd, Ru, Os, Al, Y, and $Y_2O_3$.

To secure satisfactory spark exhaustion resistance, having a melting point not lower than 2,000° C. is important for the Ir alloy to rely on excellent properties of Ir which has inherently a high melting point.

Furthermore, using a pure Ir firing tip containing no additive will encounter with the problem of oxidation and volatilization of Ir. To solve this problem, employing the above-described additive materials makes it possible to form a film on the tip surface during the engine operation, thereby effectively suppressing the oxidation and volatilization of Ir.

Figure 3A:
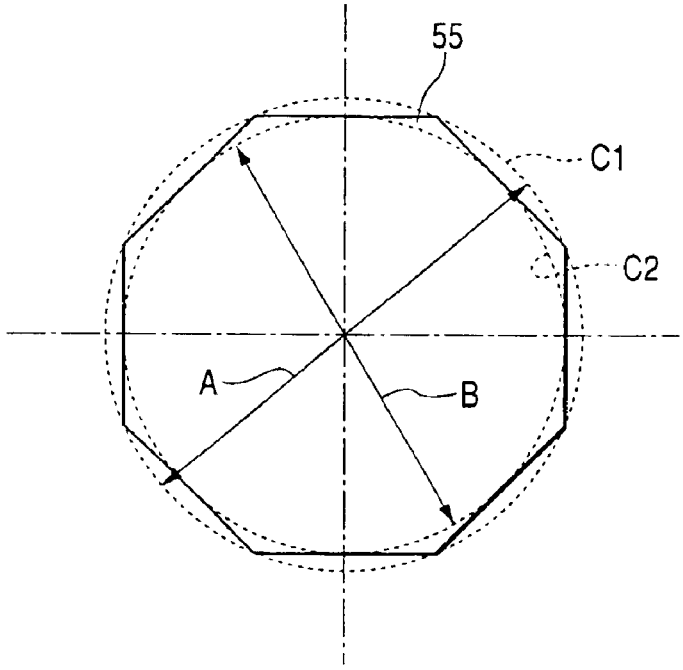
FIGS. 3A and 3B are views showing examples of a tip cross-sectional area of a rod-like Ir alloy firing tip shown in FIG. 1, taken along a plane perpendicular to the axis of the firing tip.
Figure 3B:
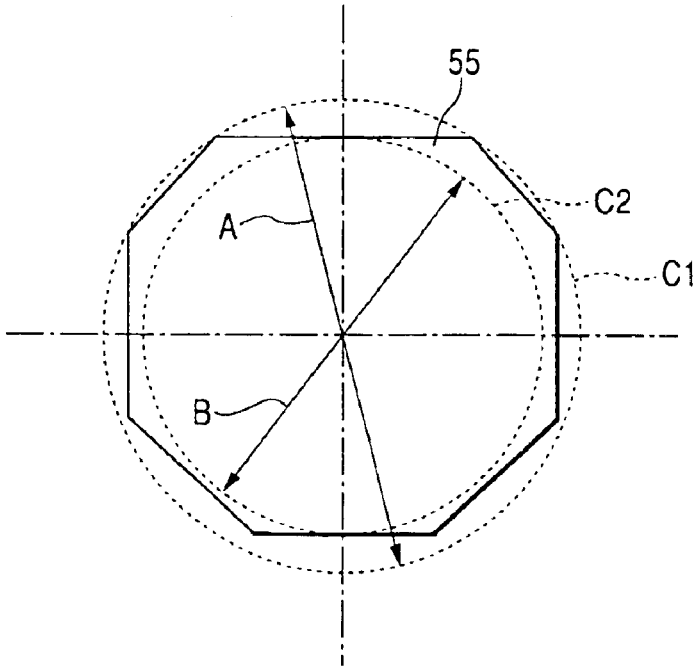

Furthermore, according to the above-described embodiment, the rod-like Ir alloy firing tips 50 and 60 employ a unique arrangement such that the configuration of the cross-sectional area (hereinafter referred to as tip cross-sectional area) taken along a plane perpendicular to the axis of the firing tip is out of round. FIGS. 3A and 3B show examples of the tip cross-sectional area 55 in respective Ir alloy firing tips 50 and 60. The tip cross-sectional area 55 shown in FIG. 3A is a regular or equilateral octagon, while the tip cross-sectional area 55 shown in FIG. 3B is an irregular or asymmetric octagon.

As indicated in FIGS. 3A and 3B, in the tip cross-sectional area 55, it is assumed that a circumscribed circle C1 has a largest diameter A among virtual circles each contacting at least three portions of a visible outline of the tip cross-sectional area 55 and an inscribed circle C2 has a largest diameter B among inscribed circles each being coaxial with the circumscribed circle C1.

According to the example shown in FIG. 3A, the circumscribed circle C1 is brought into contact with all of eight vertices of the regular octagon. The inscribed circle C2 is brought into contact with all of eight line segments of the regular octagon. On the other hand, according to the example shown in FIG. 3B, the circumscribed circle C1 is brought into contact with only four, being located in the upper half thereof, of the eight vertices of the irregular octagon. The inscribed circle C2 is brought into contact with two, being located at the upper and lower portions, of the eight line segments of the irregular octagon. According to this embodiment, the ratio B/A (i.e., a ratio of the diameter B to the diameter A) is equal to or larger than 0.8 and is less than 1.0.

Figure 4B:
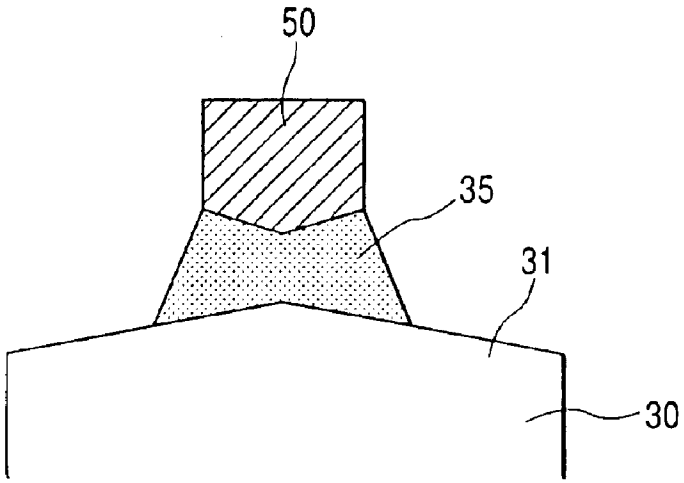
FIGS. 4A and 4B are views explaining the method of bonding the rod-like Ir alloy firing tip to an electrode base material.
Figure 4A:
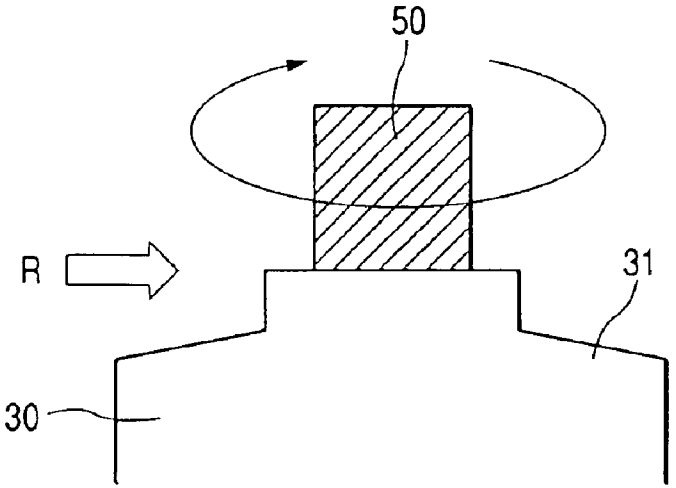

A conventionally well-known manufacturing method can be used to manufacture the spark plug S1. The method for bonding the Ir alloy firing tips 50 and 60 to respective electrode base materials 30 and 40 will be explained with reference to FIGS. 4A and 4B. The illustration of FIGS. 4A and 4B is given to explain the bonding of the center electrode firing tip 50 to the electrode base material 30. However, the similar illustration will be given to explain the bonding of the ground electrode firing tip 60 to the electrode base material 40.

First of all, the Ir alloy firing tips 50 and 60 are prepared by applying the rolling, wiredrawing, and cutting processes to an Ir alloy ingot according to the method described in the above-described prior art document.

As shown in FIG. 4A, the Ir alloy firing tip 50 is integrally connected beforehand by resistance welding to the one end portion 31 of the electrode base material (i.e., center electrode) 30. A laser R is irradiated to the entire circumferential surface of the Ir alloy firing tip 50, while the integrated assembly is rotated about the axis of Ir alloy firing tip 50. According to the illustrated example, the center electrode 30 has a small-diameter portion swelling from the one end portion 31. The small-diameter portion of the center electrode 30 is fused when the laser R is irradiated from the lateral direction.

Thus, as shown in FIG. 4B, the irradiation of laser R leaves a fused layer 35 in which the electrode base material and the Ir alloy are fused and mixed together. The one end portion of the rod-like firing tip 50 is bonded via the fused layer 35 to the center electrode 30. The fused layer 35 has an intermediate thermal expansion coefficient compared with those of the Ir alloy and the electrode base material, and accordingly reduces a thermal stress acting between the Ir alloy firing tip and the electrode and assures excellent bondability between them.

Next, the reason why the ratio B/A should be set to a range equal to or larger than 0.8 and less than 1.0 in the arrangement of the above-described embodiment will be explained. This optimization is based on the result of the following evaluations with respect to the relationship between the tip cross-sectional configuration and the bondability.

Figure 5A:
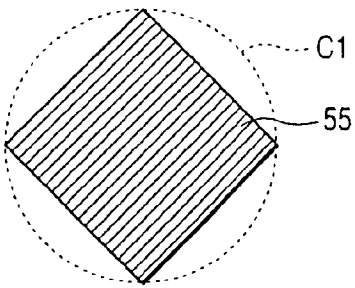
FIGS. 5A to 5F are views showing the tip cross-sectional configuration of various kinds of rod-like Ir alloy firing tips prepared for evaluation tests conducted by the inventors.
Figure 5B:
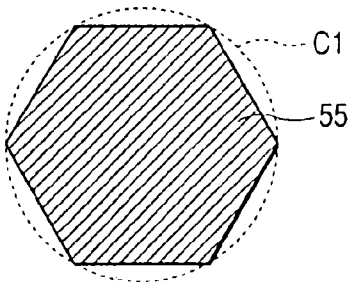
Figure 5C:
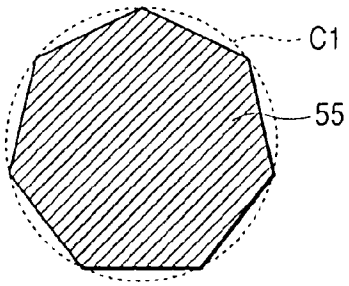
Figure 5D:
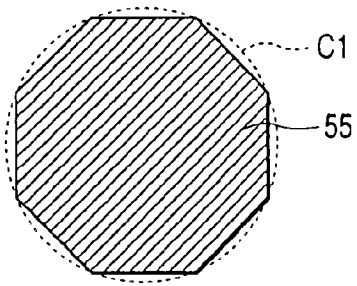
Figure 5E:
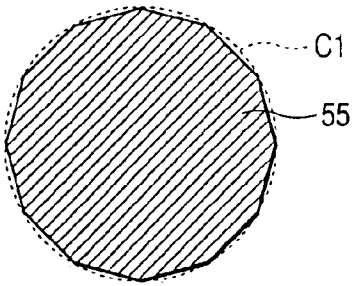
Figure 5F:
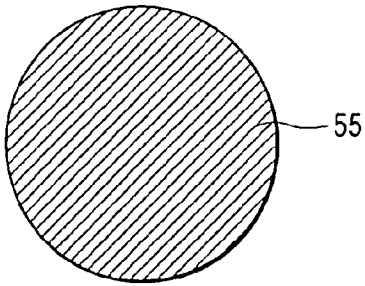

FIGS. 5A to 5E show various kinds of rod-like Ir alloy firing tips prepared for evaluation tests. Each of the prepared rod-like Ir alloy firing tips has a regular polygonal cross-sectional configuration in its tip cross-sectional area 55. More specifically, the tip cross-sectional area 55 shown in FIG. 5A is a regular or equilateral quadrangle (i.e., square). The tip cross-sectional area 55 shown in FIG. 5B is a regular hexagon. The tip cross-sectional area 55 shown in FIG. 5C is a regular heptagon. The tip cross-sectional area 55 shown in FIG. 5D is a regular octagon. The tip cross-sectional area 55 shown in FIG. 5E is a dodecagon. For comparison, FIG. 5F shows a rod-like Ir alloy firing tip having a completely round cross-sectional configuration. Namely, the tip cross-sectional area 55 shown in FIG. 5F is a circle. The rod-like Ir alloy firing tips shown in FIGS. 5A to 5F are respectively referred to as "sample 1."

In FIGS. 5A to 5E, the diameter A of the circumscribed circle C1 connecting respective vertices of each polygonal cross-sectional area 55 is 0.7 mm. The diameter of a circle shown in FIG. 5F is 0.7 mm.

Meanwhile, to evaluate the limitation with respect to the symmetry of the polygonal cross-sectional area 55 of the Ir alloy firing tip, various kinds of rod-like Ir alloy firing tips are prepared. The prepared rod-like Ir alloy firing tips for this evaluation are all octagonal but are differentiated in the ratio B/A from 0.7 to 0.92 (corresponding to regular octagon). These octagonal rod-like Ir alloy firing tips are respectively referred to as "sample 2."

The Ir alloy firing tips used as samples 1 and 2 in the above-described evaluations have the composition of Ir-10 wt % Rh (i.e., an alloy containing Ir of 90 wt % and Rh of 10 wt %). A heat-resisting Ni alloy is used for the electrode base material to which the Ir alloy firing tip is welded. The laser welding operation for bonding each firing tip of samples 1 and 2 onto the electrode base material was performed according to the method explained with reference to FIGS. 4A and 4B. The laser beam was irradiated by 8-point irradiation to the entire circumferential bonding surface.

Evaluations for the bondability were conducted in the following manner. In a 2,000 cc engine, each Ir ally firing tip sample was subjected to the thermal shock test consisting of 3,000 temperature cycles. Each temperature cycle includes one minute full-throttle driving at the engine speed of 6,000 rpm and succeeding one minute idle driving. The conducted thermal shock test is substantially equivalent to $10\times10^4$ km traveling of an ordinary automotive vehicle. The bondability in the above-described thermal shock test was evaluated by the peel rate defined in the illustration of FIG. 6.

Figure 6:
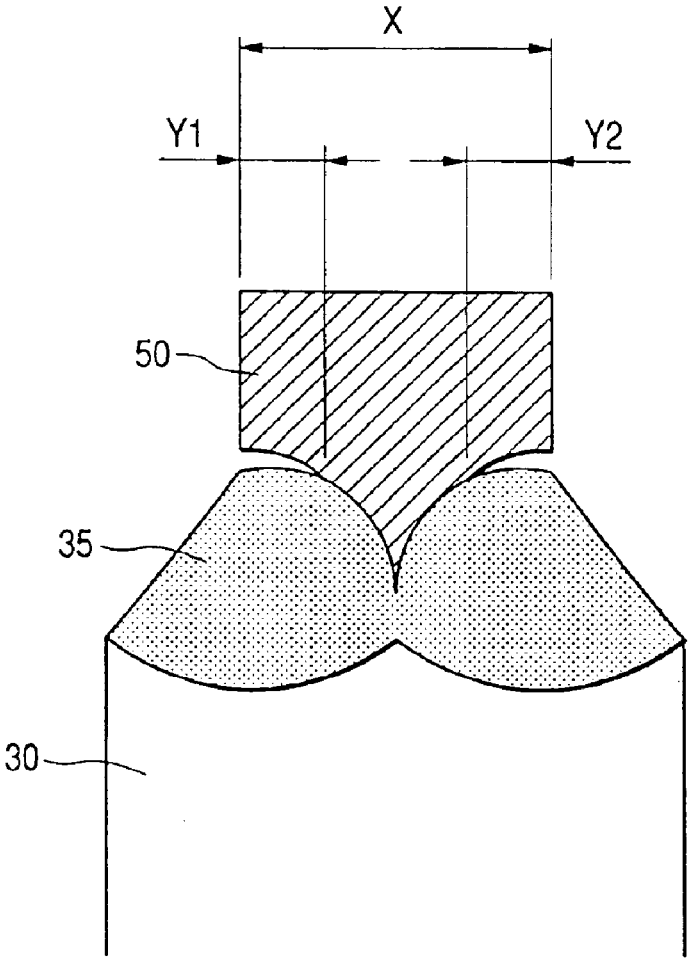
FIG. 6 is a view explaining the definition of a peel rate used as a parameter evaluating the bondability.

As understood with reference to the illustration of FIG. 6, the peel rate is defined by a formula $\{Y1+Y2)/X\}\times100$ (%), wherein X represents the length of an initial bonding interface between the electrode base material 30 and the Ir alloy firing tip 50, and Y1 and Y2 represent the length of a portion of the Ir alloy firing tip 50 having been partially peeled off the electrode base material 30 as a result of the conducted thermal shock test. When the peel rate is not larger than 25%, it can be judged that the bondability is secured.

Figure 7:
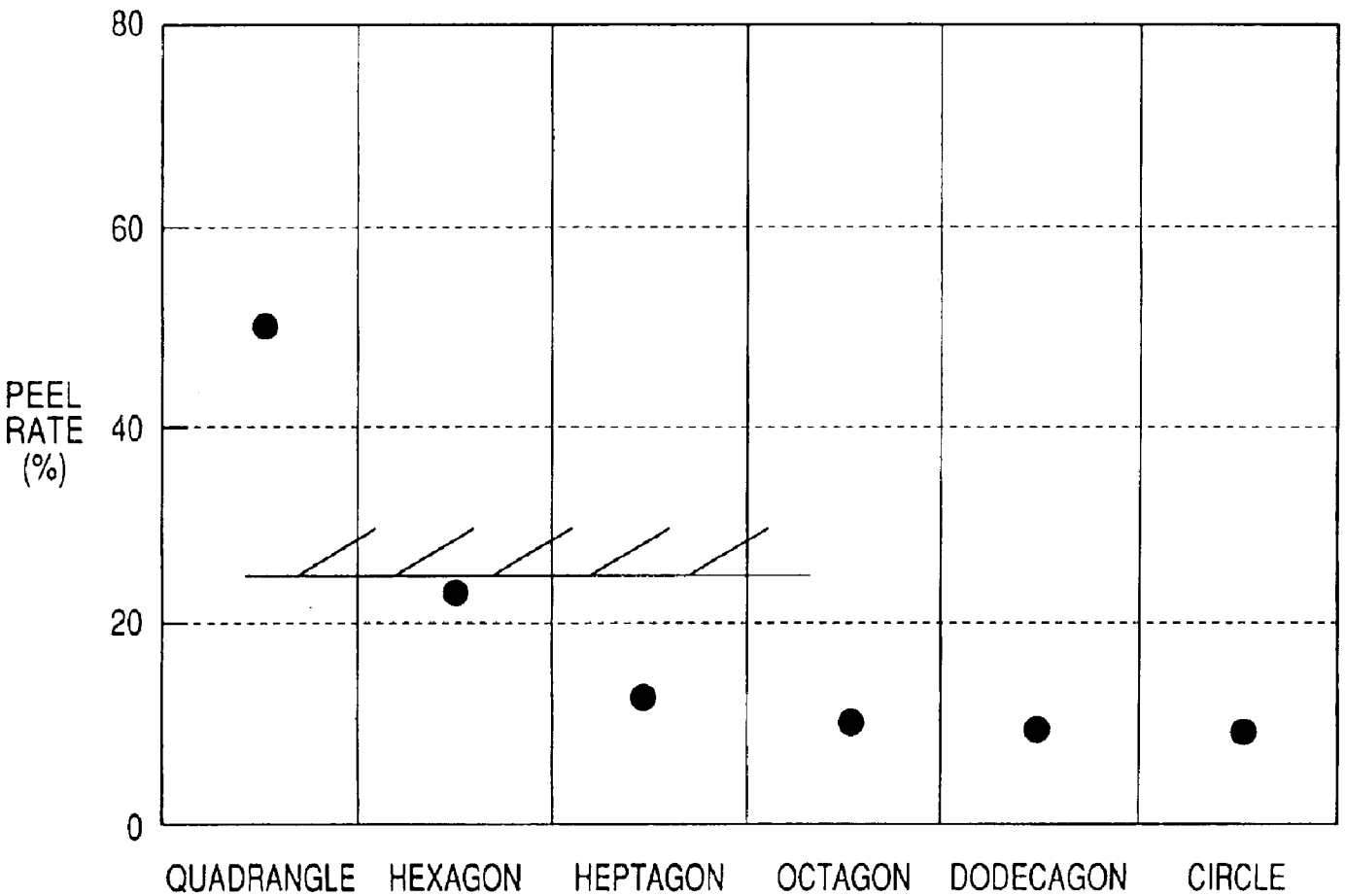
FIG. 7 is a graph showing the relationship between the peel rate and the cross-sectional configuration of the various kinds of rod-like Ir alloy firing tips used in the evaluation tests.
Figure 8:
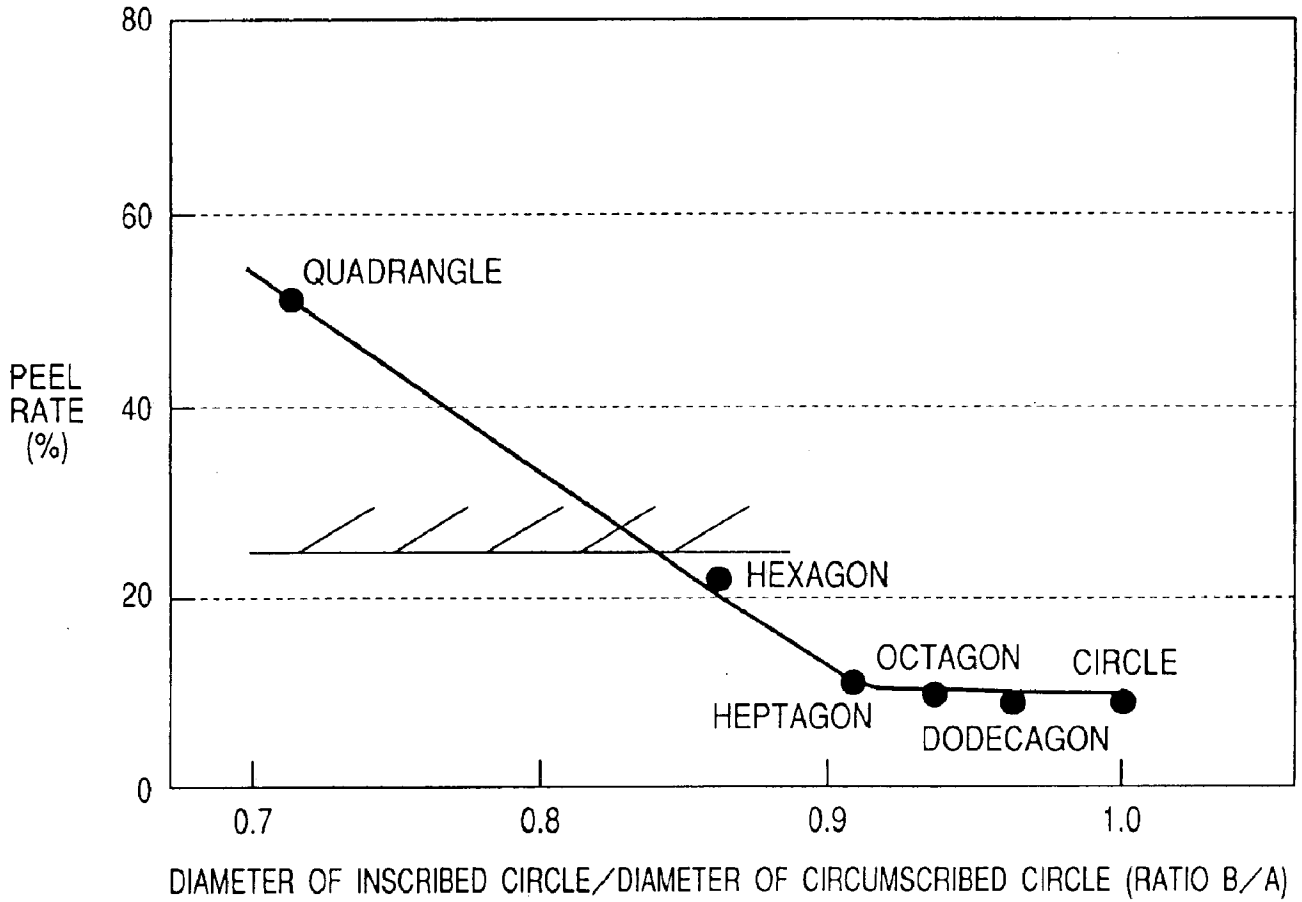
FIG. 8 is a graph showing the relationship between the peel rate and a ratio B/A of the various kinds of rod-like Ir alloy firing tips used in the evaluation tests.
Figure 9:
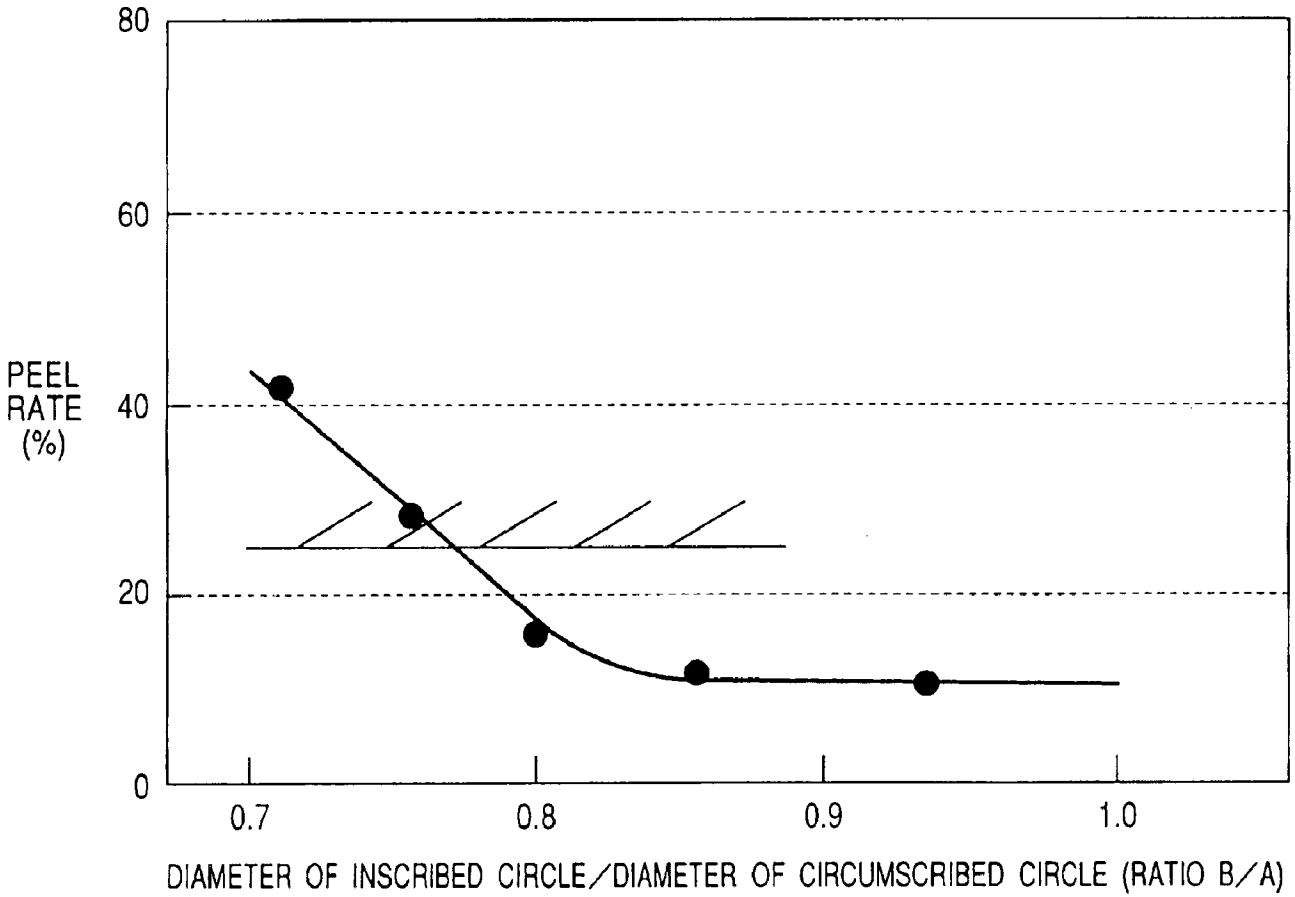
FIG. 9 is a graph showing the relationship between the peel rate and a ratio B/A of another rod-like Ir alloy firing tips each having an octagonal cross-sectional area.

FIGS. 7 to 9 show the result of evaluations with respect to the thermal shock test and the peel rate conducted on the samples 1 and 2 of the Ir alloy firing tip being bonded to the electrode base material.

FIG. 7 is a graph showing the peel rate of tested Ir alloy firing tips (i.e., sample 1) which are differentiated in the tip cross-sectional area 55. FIG. 8 is a graph showing the peel rate of the tested Ir alloy firing tips (i.e., sample 1) in relation to the ratio B/A. The ratio B/A varies in accordance with modification of the tip cross-sectional area 55. FIG. 9 is a graph showing the peel rate of another tested Ir alloy firing tips (i.e., sample 2) in relation to the ratio B/A. The ratio B/A varies in accordance with modification of symmetry of the octagonal tip cross-sectional shape.

From the evaluation result shown in FIGS. 7 and 8, it can be concluded that the hexagonal tip cross-sectional configuration can attain a target level in the peel rate although the attained level is dissatisfactory when compared with the result of a completely round tip cross-sectional configuration. On the other hand, the heptagonal, octagonal, and dodecagonal tip cross-sectional configurations can assure reliable bondability equivalent to that of the completely round tip cross-sectional configuration.

According to microscopic observation, it was confirmed that the hexagonal firing tip and other polygonal firing tips having polyhedral surfaces less in number than those of the hexagonal firing tips are inferior in that the process and the degree of fusing the firing tip is greatly differentiated. The depth of the fused portion is shallow at each vertex and its vicinity where the laser is irradiated. A concentrated stress is generated due to the edge effect. The bondability is believed to be lowered due to these causes.

Furthermore, from the evaluation result shown in FIG. 9, it can be concluded that setting the ratio B/A to be equal to or larger than 0.8 makes it possible to assure reliable bondability equivalent to that of the completely round tip cross-sectional configuration. It is believed that, when the ratio B/A is equal to or larger than 0.8, the difference in the fusing process or degree during the laser welding can be reduced sufficiently.

Furthermore, the concentrated stress is large when the apical angle of the polygonal tip cross-sectional area is small. This will give adverse influence to the bondability. Considering the above-described evaluation results, it is preferable that the apical angle should be equal to or larger than 125°. This in because, as explained with reference to the evaluation result shown in FIGS. 7 and 8, the polygonal firing tips having polyhedral surfaces whose number is equal to or larger than those of the heptagonal firing tip can assure reliable bondability equivalent to that of the completely round firing tip.

Furthermore, all of line segments defining the tip cross-sectional area need not to be straight. Some or all of line segments defining the tip cross-sectional area can be constituted by curved lines. Because the bondability of the Ir alloy firing tip can be assured as far as the apical angle (i.e., the angle between two adjacent line segments) of the firing tip satisfies the above-described relationship.

Furthermore, some of the vertices of the polygonal tip cross-sectional area may be concave. In this case, it is preferable that the apical angle of the concave vertex is not larger than 235° so that the concentrated stress caused by the edge effect can be reduced by the same degree compared with the convex vertex.

Based on the result of the above-described evaluations, this embodiment employs the characteristic arrangement such that the tip cross-sectional area (i.e. cross-sectional area taken along a plane perpendicular to the firing tip axis) 55 of respective Ir alloy firing tips 50 and 60 has an out-of-round configuration and the ratio B/A (i.e., the ratio of the diameter B of the inscribed circle C2 to the diameter A of the circumscribed circle C1) in the tip cross-sectional area 55 is set to be equal to or larger than 0.8 and is less than 1.0.

According to this arrangement, the Ir alloy firing tips 50 and 60 can be made of a material having an out-of-round shape, such as a polygonal rod, in the configuration of the tip cross-sectional area 55. The machining or manufacturing costs of the Ir alloy firing tips 50 and 60 can be reduced greatly compared with the costs for a columnar firing tip. The machining or manufacturing processes can be simplified.

It is experimentally confirmed that, even if the tip cross-sectional configuration is out of round, setting the ratio B/A to be equal to or larger than 0.8 and less than 1.0 makes it possible to assure excellent bondability equivalent to that of the columnar Ir alloy firing tip.

Accordingly, the above-described embodiment provides a spark plug capable of not only simplifying the machining or manufacturing processes of the Ir alloy firing tip but also securing the bondability of the firing tip which is welded to the electrode base material by the laser welding operation.

The preferable upper limit of the ratio B/A is 0.96. In the experimental result of FIG. 8, the ratio B/A=0.96 is substantially identical with the ratio B/A of the firing tip having a dodecagonal tip cross-sectional area. Thus, this is the experimentally confirmed upper limit for assuring the bondability.

Furthermore, to realize the above-described optimum range of the ratio B/A for the tip cross-sectional area 55, the visible outline of the cross-sectional area 55 is constituted by a serial joint of at least seven straight or curved line elements (i.e., line segments), and an angle between each line element and an adjacent line element is not less than 125° and is not larger than 235°. The following is the reason why this arrangement is employed.

Figure 10A:
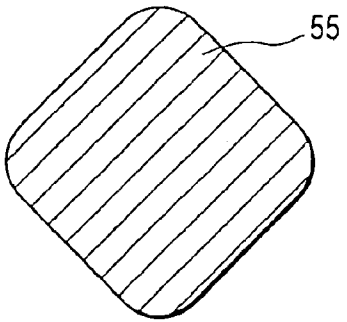
FIGS. 10A to 10E are views showing various examples of the tip cross-sectional area whose visible outline includes at least one curved line segment.
Figure 10B:
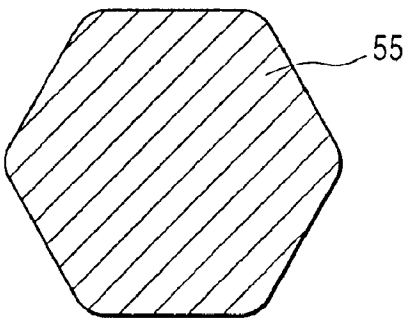
Figure 10C:
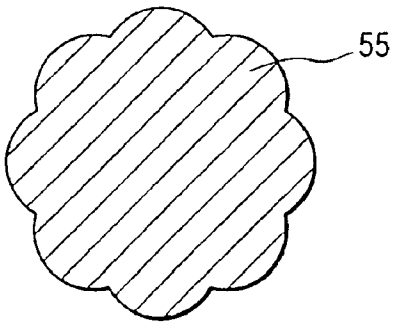
Figure 10D:
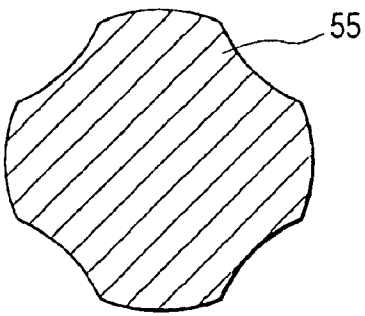
Figure 10E:
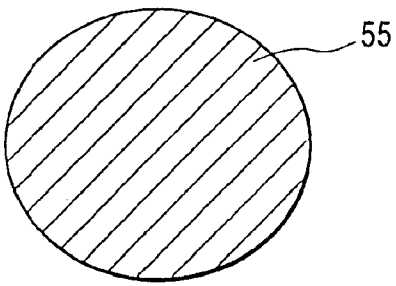

FIGS. 10A to 10E show various examples of the tip cross-sectional area 55 whose visible outline includes at least one curved line segment as one of constituent line elements. The Ir alloy firing tips 50 and 60 of the above-described embodiment can be modified so as to have the tip cross-sectional area 55 shown in FIGS. 11A to 10E. FIGS. 10C and 10D show the examples of tip cross-sectional area 55 including a concave portion formed between two adjacent line elements. FIG. 10E shows an elliptic tip cross-sectional area 55 in which a ratio of minor radius to a major radius is equal to or larger than 0.8 and is less than 1.0.

Furthermore, according to the above-described embodiment, the diameter A of the circumscribed circle C1 is not less than 0.3 mm and is not larger than 1.5 mm from the following reasons.

If the diameter A of the circumscribed circle C1 is less than 0.3 mm, the thermal capacity of the Ir alloy firing tip will be too small even if this firing tip has excellent exhaustion resistance. Due to tip temperature increase, exhaustion of the firing tip will be so promoted that satisfactory lifetime cannot be assured. On the other hand, if the diameter A of the circumscribed circle C1 is larger than 1.5 mm, the tip size becomes too large to reduce the thermal stress for assuring sufficient bondability even if a fused layer serving as a relaxing layer is formed by laser welding.

Furthermore, according to the above-described embodiment, the Ir alloy firing tips 50 and 60 are bonded along their entire circumferential surfaces by laser welding to the opposed portions of the center electrode 30 and the ground electrode 40 (i.e., electrode base material) facing to the discharge gap 70.

Figure 11B:
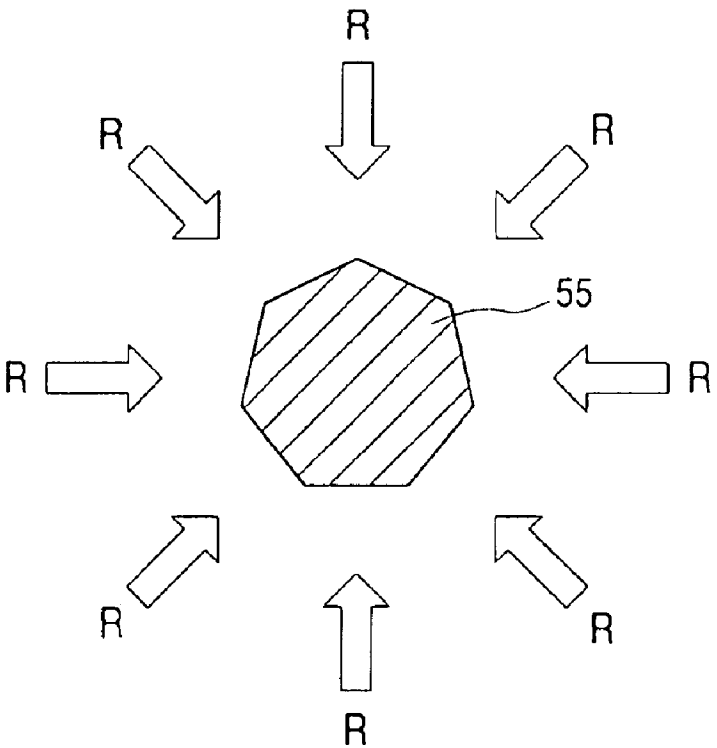
FIG. 11B is a view explaining a laser welding operation according to which the 8-point equiangular laser beams are irradiated only to respective vertices of the octagonal firing tip.
Figure 11A:
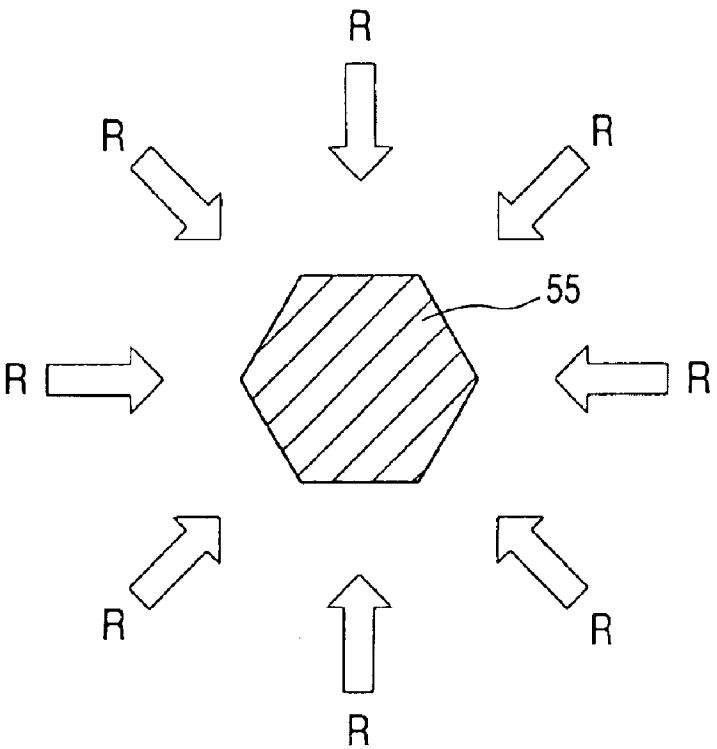
FIG. 11A is a view explaining a laser welding operation using 8-point equiangular laser beams being irradiated only to respective polyhedral faces of an octagonal firing tip.

By performing the laser welding under the same conditions, the bonding reliability can be assured even if the laser beam is irradiated to arbitrary portions in the bonding interface. For example, FIGS. 11A and 11B show the laser welding operation of 8-point equiangular irradiations each being applied under the same conditions to the Ir alloy firing tip 30 having a regular octagonal cross-sectional configuration which is integrated beforehand with the electrode base material 30. FIG. 1A shows the laser welding operation according to which the 8-point equiangular laser beams are irradiated only to respective polyhedral faces of the octagonal firing tip. FIG. 11B shows the laser welding operation according to which the 8-point equiangular laser beams are irradiated only to respective vertices of the octagonal firing tip.

In the laser welding operations shown in FIGS. 11A and 11B, it is experimentally confirmed that the bonding reliability can be assured regardless of the positioning of 8-point equiangular laser beams. Thus, according to the above-described embodiment, it is possible to irradiate the laser beams only to respective polyhedral faces of the octagonal firing tip, or only to respective vertices of the octagonal firing tip, or to both to them. Thus, the above-described embodiment brings the advantages in that welding conditions need not be changed according to the configuration of the firing tip and the irradiating positions of the laser beams need not be specified.

Furthermore, according to the illustrated example shown in FIGS. 4A and 4B, the center electrode 30 has the small-diameter portion swelling from the one end portion 31. The small-diameter portion of the center electrode 30 is fused when the laser R is irradiated from the lateral direction. However, it is possible to omit the small-diameter portion.

Figure 12A:
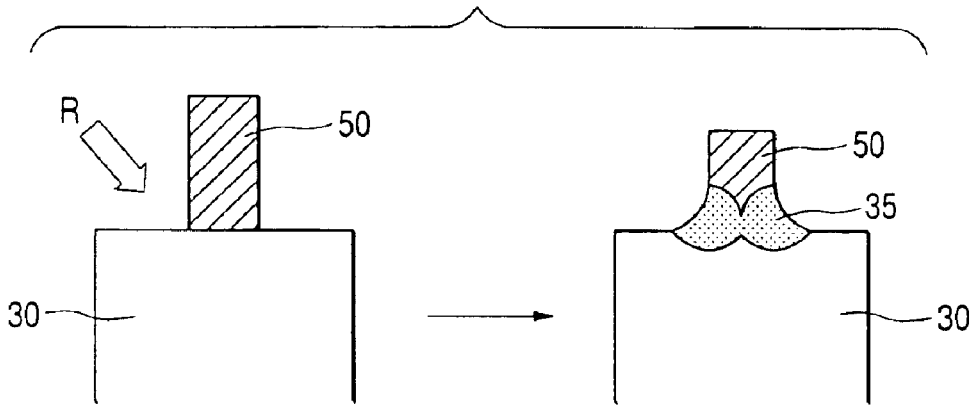
FIGS. 12A and 12B are views explaining another laser welding operations.
Figure 12B:
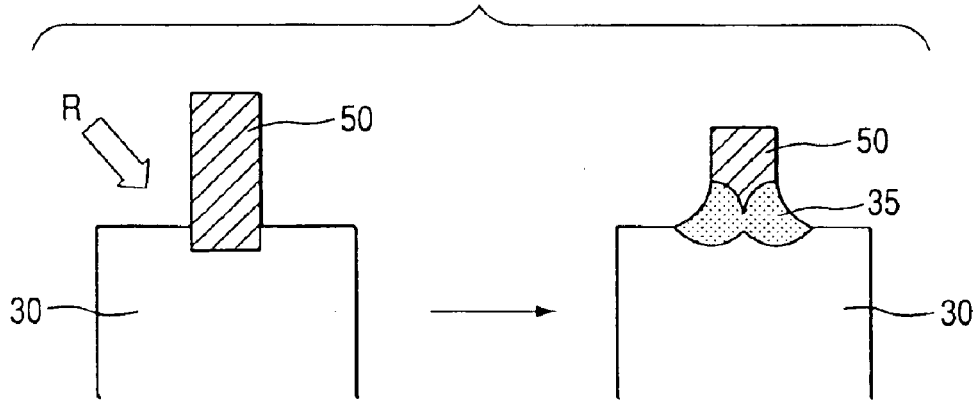
Figure 11A:
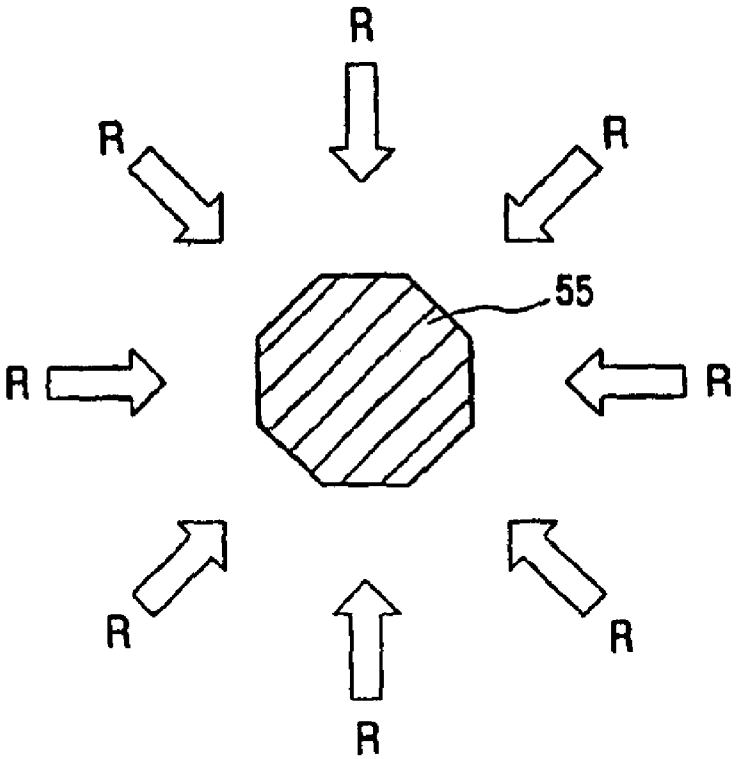
Figure 11B:
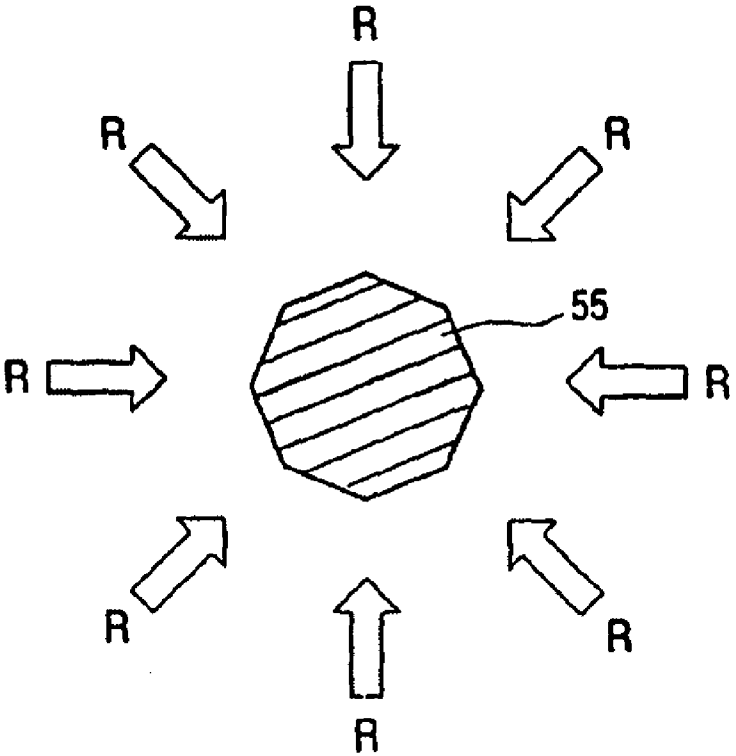

For example, as shown in FIG. 12A, it is possible to place and integrate the Ir alloy firing tip 50 on a flat end surface of the electrode base material 30 having no small-diameter portion and irradiate the laser R from an oblique upper direction. Alternately, as shown in FIG. 12B, it is possible to place and integrate the Ir alloy firing tip 50 into a recess formed on the end surface of the electrode base material 30 and irradiate the laser R from an oblique upper direction. In other words, the above-described embodiment is not subjected to severe restrictions with respect to the relationship between the firing tip and the electrode base material to be bonded by the laser welding as well as in the irradiation angle of the laser beams.

As apparent from the foregoing description, the preferred embodiments of the present invention provides a spark plug including a center electrode (30), an insulator (20) holding the center electrode, a housing (10) holding and fixing the insulator, and a ground electrode (40) having one end portion connected to the housing and the other end portion opposed to the center electrode via a discharge gap (70) intervening therebetween. An Ir alloy firing tip (50, 60) made of a rod-like Ir alloy is connected to a portion of at least one of the center electrode and the ground electrode facing to the discharge gap. A cross-sectional area (55) of the Ir alloy firing tip taken along a plane perpendicular to an axis of the Ir alloy firing tip has an out-of-round configuration. In the cross-sectional area of the Ir alloy firing tip, when a circumscribed circle (C1) has a largest diameter A among virtual circles contacting at least three portions of a visible outline of the cross-sectional area and an inscribed circle (C2) has a largest diameter B among inscribed circles being coaxial with the circumscribed circle (C1), a ratio of the diameter B to the diameter A (i.e., B/A) is equal to or larger than 0.8 and is less than 1.0. The visible outline of the cross-sectional area (55) is constituted by a serial joint of at least seven straight or curved line elements, and an angle between each line element and an adjacent line element is not less than 125° and is not larger than 235°.

The above-described reference numerals in parentheses represent the relationship or correspondence to above-described components or portions disclosed in the above-described preferable embodiments of this invention.

According to the spark plug of this invention, the shape of the Ir alloy firing tip is out of round in the cross-sectional configuration taken along a plane perpendicular to the axis of the Ir alloy firing tip. It is thus possible to use many types of Ir alloy firing tips which are polygonal or non-columnar in the cross-sectional configuration. The machining or manufacturing costs can be reduced greatly compared with the case that the firing tip is configured into a columnar shape. Thus, the machining oe manufacturing processes for the Ir alloy firing tip can be simplified.

Accordingly, the present invention can provide a spark plug capable of simplifying the machining processes for the Ir alloy firing tip and also securing the bondability of the Ir alloy firing tip in the laser welding operation.

Preferably, the ratio B/A is not larger than 0.96.

Preferably, the diameter A of the circumscribed circle (C1) is not less than 0.3 mm and is not larger than 1.5 mm from the following reasons.

Preferably, the Ir alloy firing tip (50, 60) includes Ir of 50% or more by weight and at least one additive, and has a melting point not lower than 2,000° C.

Preferably, at least one additive contained in the Ir alloy firing tip (50, 60) is selected from the group consisting of Pt, Rh, Ni, W, Pd, Ru, Os, AI, Y, and $Y_2O_3$. These additives possess the capability of forming a film on the surface of the firing tip and accordingly effectively suppress oxidation and volatilization of Ir.

Furthermore, the present invention provides a method for manufacturing a spark plug including a center electrode (30), an insulator (20) holding the center electrode, a housing (10) holding and fixing the insulator, and a ground electrode (40) having one end portion connected to the housing and the other end portion opposed to the center electrode via a discharge gap (70) intervening therebetween, wherein an Ir alloy firing tip (50, 60) made of a rod-like Ir alloy is connected to a portion of at least one of the center electrode and the ground electrode facing to the discharge gap. More specifically, a cross-sectional area (55) of the Ir alloy firing tip taken along a plane perpendicular to an axis of the Ir alloy firing tip has an out-of-round configuration. In the cross-sectional area of the Ir alloy firing tip, when a circumscribed circle (C1) has a largest diameter A among virtual circles contacting at least three portions of a visible outline of the cross-sectional area and an inscribed circle (C2) has a largest diameter B among inscribed circles being coaxial with the circumscribed circle (C1), a ratio of the diameter B to the diameter A (i.e., B/A) is equal to or larger than 0.8 and is less than 1.0.

The manufacturing method of the present invention includes a step of configuring the cross-sectional area (55) of the Ir alloy firing tip in such a manner that the visible outline is constituted by a serial joint of at least seven straight or curved line elements and an angle between each line element and an adjacent line element is not less than 125° and not larger than 235°, and a step of welding an entire circumferential surface of the Ir alloy firing tip by laser welding to the portion of at least one of the center electrode and the ground electrode facing to the discharge gap.

What is claimed is:

1. A spark plug comprising:

a center electrode;

an insulator holding said center electrode;

a housing holding and fixing said insulator; and a ground electrode having one end portion connected to said housing and the other end portion opposed to said center electrode via a discharge gap intervening therebetween, wherein an Ir alloy firing tip made of a rod-like Ir alloy is connected to a portion of at least one of said center electrode and said ground electrode facing to said discharge gap, a cross-sectional area of said Ir alloy firing tip taken along a plane perpendicular to an axis of said Ir alloy firing tip has an out-of-round configuration, in said cross-sectional area of said Ir alloy firing tip, when it is assumed that a circumscribed circle has a largest diameter A among virtual circles each contacting at least three portions of a visible outline of said cross-sectional area and an inscribed circle has a largest diameter B among inscribed circles each being coaxial with said circumscribed circle, a ratio of said diameter B to said diameter A (i.e., B/A) is equal to or larger than 0.8 and is less than 1.0, the visible outline of said cross-sectional area is constituted by a serial joint of at least seven straight or curved line elements, and an angle between each line element and an adjacent line element is not less than 125° and is not larger than 235°.

2. The spark plug in accordance with claim 1, wherein said ratio B/A is not larger than 0.96.

3. The spark plug in accordance with claim 1, wherein the diameter A of said circumscribed circle is not less than 0.3 mm and is not larger than 1.5 mm.

4. The spark plug in accordance with claim 1, wherein said Ir alloy firing tip includes Ir of 50% or more by weight and at least one additive, and has a melting point not lower than 2,000° C.

5. The spark plug in accordance with claim 4, wherein said at least one additive contained in said Ir alloy firing tip is selected from the group consisting of Pt, Rh, Ni, W, Pd, Ru, Os, Al, Y, and $Y_2O_3$.

6. A method for manufacturing a spark plug including a center electrode, an insulator holding said center electrode, a housing holding and fixing said insulator, and a ground electrode having one end portion connected to said housing and the other end portion opposed to said center electrode via a discharge gap intervening therebetween, wherein an Ir alloy firing tip made of a rod-like Ir alloy is connected to a portion of at least one of said center electrode and said ground electrode facing to said discharge gap, and a cross-sectional area of said Ir alloy firing tip taken along a plane perpendicular to an axis of said Ir alloy firing tip has an out-of-round configuration, in said cross-sectional area of said Ir alloy firing tip, when it is assumed that a circumscribed circle has a largest diameter A among virtual circles each contacting at least three portions of a visible outline of said cross-sectional area and an inscribed circle has a largest diameter B among inscribed circles each being coaxial with said circumscribed circle, a ratio of said diameter B to said diameter A (i.e., B/A) is equal to or larger than 0.8 and is less than 1.0, wherein said manufacturing method includes the steps of:

configuring said cross-sectional area of said Ir alloy firing tip in such a manner that the visible outline is constituted by a serial joint of at least seven straight or curved line elements and an angle between each line element and an adjacent line element is not less than 125° and not larger than 235°, and welding an entire circumferential surface of said Ir alloy firing tip by laser welding to said portion of at least one of said center electrode and said ground electrode facing to said discharge gap.

* * * * *

UNITED STATES PATENT AND TRADEMARK OFFICE

CERTIFICATE OF CORRECTION

PATENT NO. : 6,885,137 B2
DATED : April 26, 2005
INVENTOR(S) : Kanao et al.

It is certified that error appears in the above-identified patent and that said Letters Patent is hereby corrected as shown below:

Drawing Sheet 11 of 12 should be deleted and replaced with the attached drawing consisting of Figs. 11A and 11B.

Signed and Sealed this

Seventh Day of March, 2006

JON W. DUDAS
*Director of the United States Patent and Trademark Office*